US006796009B1

(12) United States Patent
Liu

(10) Patent No.: US 6,796,009 B1
(45) Date of Patent: Sep. 28, 2004

(54) SHOELACE FASTENER

(75) Inventor: Kun-Chung Liu, No. 5, Alley 9, Lane 212, San Feng Rd., Hou-Li Hsiang, Taichung Hsien (TW)

(73) Assignee: Kun-Chung Liu, Hou-Li Hsiang (TW)

( * ) Notice: Subject to any disclaimer, the term of this patent is extended or adjusted under 35 U.S.C. 154(b) by 0 days.

(21) Appl. No.: 10/626,118

(22) Filed: Jul. 23, 2003

(51) Int. Cl.[7] ..... A43C 7/04
(52) U.S. Cl. ..... 24/712.6; 24/712.4; 24/712.5
(58) Field of Search ..... 24/115 H, 115 L, 24/132 R, 136 K, 136 R, 712, 712.1, 712.2, 712.4–713; 36/50, 50.1

(56) References Cited

U.S. PATENT DOCUMENTS 776,469 A * 11/1904 Hughes ..... 24/712.6
1,481,903 A * 1/1924 Hart ..... 24/712.6
1,832,738 A * 11/1931 Ray ..... 24/712.5
4,336,636 A * 6/1982 Ishiguro et al. ..... 24/712.7
5,029,370 A * 7/1991 Martinez Gimeno ..... 24/712.5
5,097,573 A * 3/1992 Gimeno ..... 24/712.6
5,924,178 A * 7/1999 Holmberg ..... 24/712.5
6,003,214 A * 12/1999 Lee ..... 24/712.1
6,094,787 A * 8/2000 Chang ..... 24/712.6
6,571,438 B2 * 6/2003 Liu ..... 24/712.2
6,718,602 B1 * 4/2004 Chang ..... 24/712.1

FOREIGN PATENT DOCUMENTS

FR 2 581 846 * 5/1986

* cited by examiner

*Primary Examiner*—Robert J. Sandy
*Assistant Examiner*—Ruth C. Rodriguez
(74) *Attorney, Agent, or Firm*—Merchant & Gould P.C.

(57) ABSTRACT

A shoelace fastener is provided for a shoe that includes a shoelace having a pair of distal lace segments. The shoelace fastener includes a pair of fastener bodies formed with a pair of through holes, respectively. Each of the fastener bodies has a clamping pin partitioning a respective through hole into a lace entry side and a lace exit side. The distal lace segments are extendable through the lace entry side, over a respective clamping pin, and into the lace exit side of the through hole in the respective fastener body. Tension applied by the shoe on the shoelace enables the clamping pins to clamp the distal lace segments against the fastener body. Pulling of the fastener bodies through a pull unit results in loosening of the shoe.

11 Claims, 7 Drawing Sheets

SHOELACE FASTENER

BACKGROUND OF THE INVENTION

1. Field of the Invention

The invention relates to a shoe accessory, more particularly to a shoelace fastener for maintaining a tightened state of a shoe.

2. Description of the Related Art

In U.S. Pat. No. 6,571,438, there is disclosed a double-bow shoelace device that is adapted to be mounted on a shoe and that includes a shoelace, a clamp member, and an assembly of two loops and a decorative knot. The shoelace has a first lace segment that is strung on the shoe, and a second lace segment that includes first and second lace portions, each of which has a lower end connected to the first lace segment. The clamp member is sleeved slidably on at least one of the lace portions, and includes an elongate casing, a clamping block slidably received in the casing, and a biasing member disposed in the casing for biasing the clamping block to a lace clamping position. Downward and upward movements of the clamp member along at least one of the lace portions result in tightening and loosening of the shoe. The assembly is disposed on and externally of the clamp member.

Although the aforesaid shoelace device serves the purpose of tightening and loosening of the shoe, there are some drawbacks associated therewith. Particularly, because the clamping block of the clamp member must be forced inwardly into the casing against the biasing action of the biasing member when it is desired to loosen the shoe, the overall size of the clamp member must be large enough for the fingers of the user to press the clamping block and the clamp member toward each other. The relatively large clamp member has an adverse affect on the appearance of the shoe. It is also noted that the assembly of the loops and the knot on the clamp member is merely for decorative purposes, and does not have any practical function associated therewith.

FIG. 1 illustrates another conventional shoelace fastener 3 for a shoelace 4 having a pair of distal lace portions 402. The fastener 3 includes a plate body formed with an inner pair of lace entry holes 301 and an outer pair of lace exit holes 302. Two resilient clamp members 303 extend integrally from the plate body into the lace exit holes 302, respectively. In use, the distal lace portions 402 are first extended through the lace entry holes 301 and are subsequently extended through the lace exit holes 302. The clamp members 303 clamp the distal lace portions 402 against the plate body of the fastener 3. Although the aforesaid shoelace fastener 3 also serves the purpose of tightening and loosening of a shoe (not shown), there are still some drawbacks associated therewith. Particularly, since the fastener 3 must be pulled upwardly when it is desired to loosen the shoe, the lack of a pull component on the fastener 3 makes it difficult to conduct the pulling operation. Moreover, the size of the fastener 3 must be relatively large in order to facilitate upward pulling of the same.

SUMMARY OF THE INVENTION

Therefore, the object of the present invention is to provide a shoelace fastener that can overcome the aforesaid drawbacks associated with the prior art.

According to the present invention, there is provided a shoelace fastener for a shoe that includes a shoe body with a pair of eyelet tabs, and a shoelace strung on the eyelet tabs and having a pair of distal lace segments. The shoelace fastener comprises first and second fastener bodies, a pivot axle, a pair of clamping pins, and a pull unit.

The first and second fastener bodies are disposed side by side in a first direction. Each of the first and second fastener bodies is formed with a through hole that has a hole axis transverse to the first direction. Each of the first and second fastener bodies further has inner and outer frame portions respectively proximate to and distal from the other of the first and second fastener bodies.

The pivot axle extends in a second direction transverse to the first direction and the hole axes, and pivotally interconnects the inner frame portions of the first and second fastener bodies.

Each of the clamping pins is movably retained on a respective one of the first and second fastener bodies, extends in the second direction, is movable along the first direction between the inner and outer frame portions of the respective one of the first and second fastener bodies, and partitions the through hole in the respective one of the first and second fastener bodies into a lace entry side proximate to the inner frame portion, and a lace exit side proximate to the outer frame portion.

The pull unit is secured on and is disposed externally of the first and second fastener bodies.

In use, each of the distal lace segments is extendable through the lace entry side of the through hole in a respective one of the first and second fastener bodies, over the clamping pin of the respective one of the first and second fastener bodies, and into the lace exit side of the through hole in the respective one of the first and second fastener bodies. Tension applied by the eyelet tabs upon the shoelace forces the clamping pins to clamp the distal lace segments respectively against the outer frame portions of the first and second fastener bodies for maintaining a tightened state of the shoe. A manual pulling force applied on the first and second fastener bodies through the pull unit results in relative pivoting movement between the first and second fastener bodies and in movement of at least one of the clamping pins toward the inner frame portion of the respective one of the first and second fastener bodies to permit sliding movement of at least one of the distal lace segments for loosening the shoe accordingly.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
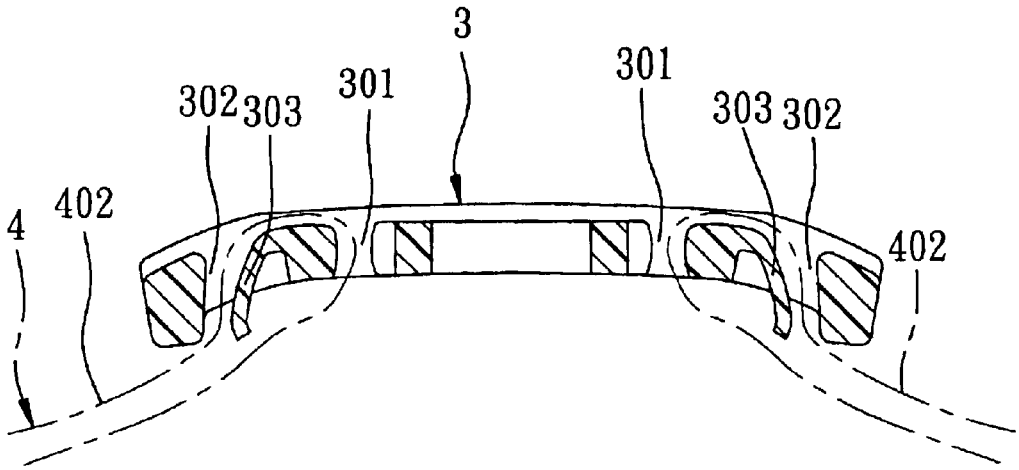
FIG. 1 PRIOR ART
FIG. 1 is a sectional view of a conventional shoelace fastener.
Figure 2:
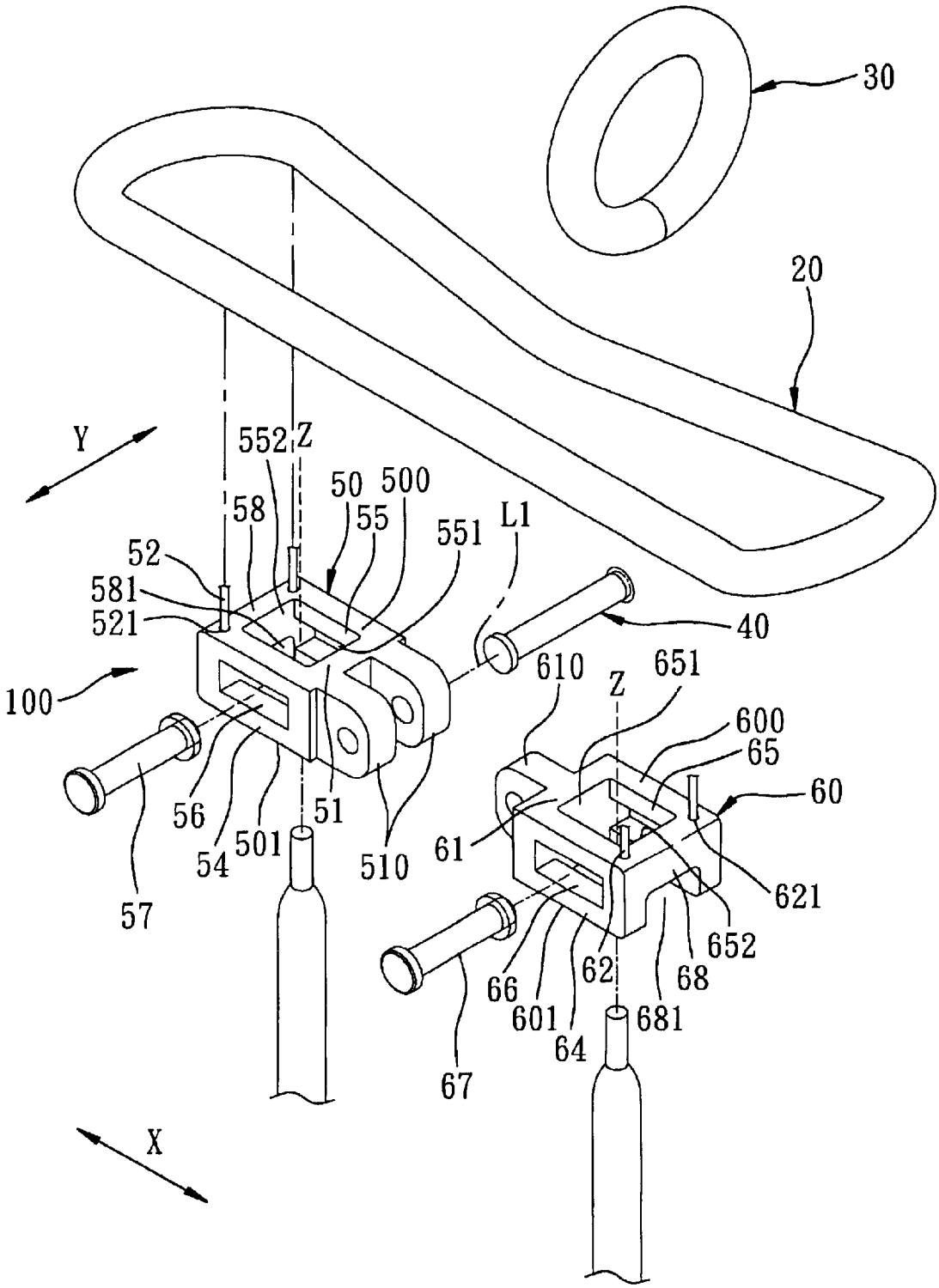
FIG. 2 is an exploded perspective view of the first preferred embodiment of a shoelace fastener according to the present invention.

Referring to FIGS. 2 to 5, the first preferred embodiment of a shoelace fastener 100 according to the present invention is shown to be adapted for use with a shoe that includes a shoe body 300 with a pair of eyelet tabs 310, and a shoelace 200 having an anchoring segment 210 strung on the eyelet tabs 310, and a pair of distal lace segments 220, each of which is connected to the anchoring segment 210 at one end. The shoelace fastener 100 includes first and second fastener bodies 50, 60, a pivot axle 40, a pair of clamping pins 57, 67, a pull unit 20, and a covering band 30. It should be noted herein that, except for FIG. 5, the shoelace fastener 100 is not drawn to scale in the accompanying drawings and is actually illustrated in a magnified form for the sake of clarity.

The first and second fastener bodies 50, 60 are disposed side by side in a first direction (X). Each of the first and second fastener bodies 50, 60 has top and bottom sides 500, 501, 600, 601, and a through hole 55, 65 that is formed through the top and bottom sides 500, 501, 600, 601 and that has a hole axis (Z) transverse to the first direction (X). Each of the first and second fastener bodies 50, 60 is generally rectangular in shape, and further has inner and outer frame portions 51, 61, 58, 68 respectively proximate to and distal from the other of the first and second fastener bodies 50, 60. Each of the inner and outer frame portions 51, 61, 58, 68 extends in a second direction (Y) transverse to the first direction (X) and the hole axes (Z). Each of the first and second fastener bodies 50, 60 further has a pair of side frame portions 54, 64 that extend in the first direction (X) and that interconnect the inner and outer frame portions 51, 61, 58, 68. Each of the side frame portions 54 is formed with a respective slot 56, 66 that extends in the first direction (X). The inner frame portion 51, 61 of each of the first and second fastener bodies 50, 60 is formed with a pivot lug unit 510, 610. In this embodiment, the outer frame portion 58, 68 of each of the first and second fastener bodies 50, 60 is formed with a pair of string holes 521, 621 parallel to the hole axis (Z).

Figure 5:
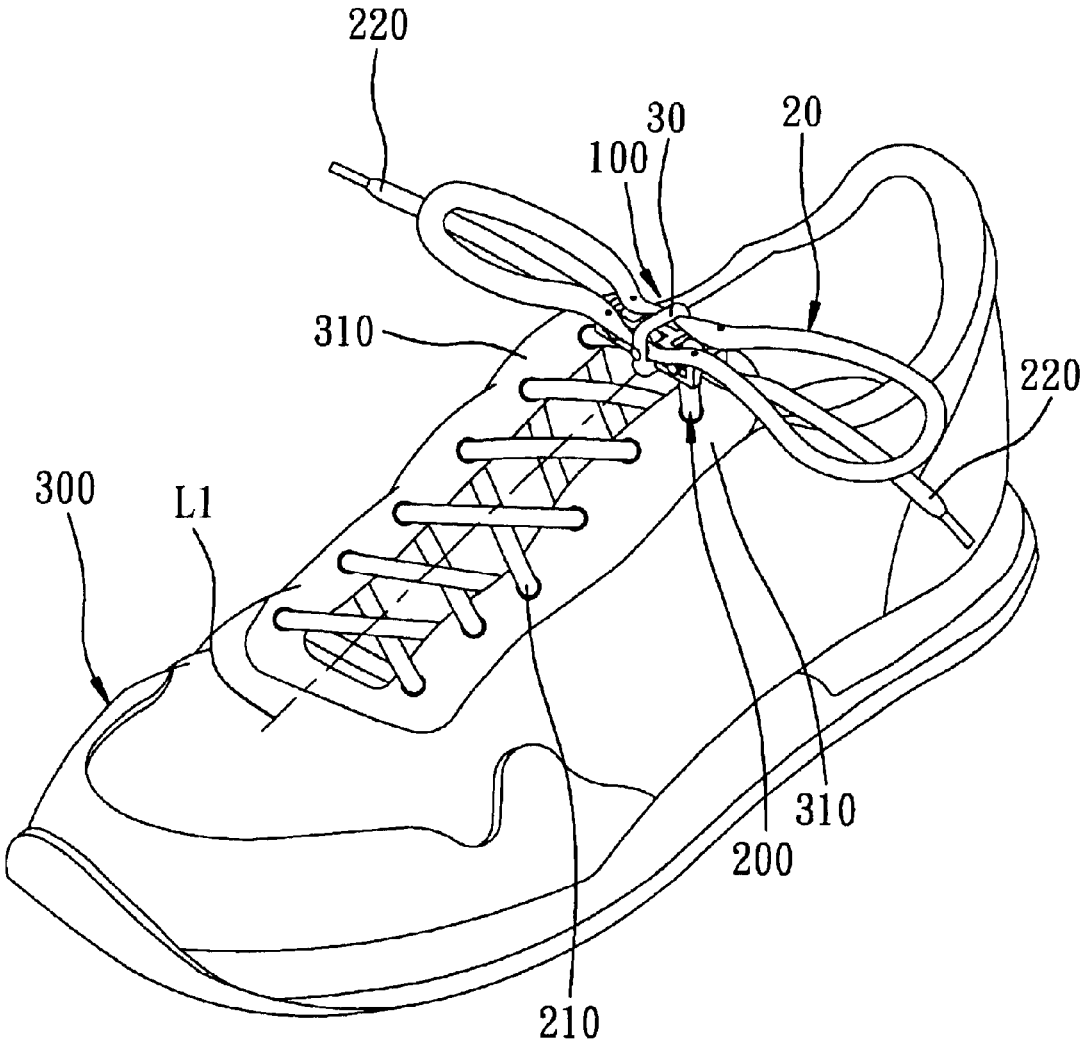
FIG. 5 is a perspective view showing a shoe that incorporates the first preferred embodiment of this invention.

The pivot axle 40 extends in the second direction (Y) through the pivot lug units 510, 610 of the inner frame portions 51, 61 of the first and second fastener bodies 50, 60, and pivotally interconnects the inner frame portions 51, 61 of the first and second fastener bodies 50, 60. In use, an axis (L1) of the pivot axle 40, which is parallel to the second direction (Y), is disposed between the eyelet tabs 310 of the shoe body 300, as best shown in FIG. 5.

Each of the clamping pins 57, 67 has opposite ends slidably retained in the slots 56, 66 in the side frame portions 54 of a respective one of the first and second fastener bodies 50, 60. Each of the clamping pins 57, 67 extends in the second direction (Y), is movable along the first direction (X) between the inner and outer frame portions 51, 61, 58, 68 of the respective one of the first and second fastener bodies 50, 60, and partitions the through hole 55, 65 in the respective one of the first and second fastener bodies 50, 60 into a lace entry side 551, 651 proximate to the inner frame portion 51, 61, and a lace exit side 552, 652 proximate to the outer frame portion 58, 68. Preferably, the outer frame portion 58, 68 of each of the first and second fastener bodies 50, 60 is formed with a respective lace notch 581, 681 that extends from the bottom side 501, 601. The lace notches 581, 681 are aligned in the first direction (X), and are in spatial communication with the lace exit side 552, 652 of a respective one of the through holes 55, 65.

The pull unit 20 of this embodiment is an endless loop that is preferably made of the same material as the shoelace 200 and that cooperates with the distal lace segments 220 of the shoelace 200 to form a double-bow configuration. Moreover, the pull unit 20 has parallel loop segments secured to opposite ends of the pivot axle 40, respectively. Each of a plurality of strings 52, 62 has a connecting end connected to the pull unit 20, extends through a respective string hole 521, 621 in the outer frame portions 58, 68 of the first and second fastener bodies 50, 60, and further has an anchoring end formed with a knot that abuts against the bottom side 501, 601 of the respective one of the first and second fastener bodies 50, 60, thereby connecting the pull unit 20 to the outer frame portions 58, 68 of the first and second fastener bodies 50, 60.

Figure 4:
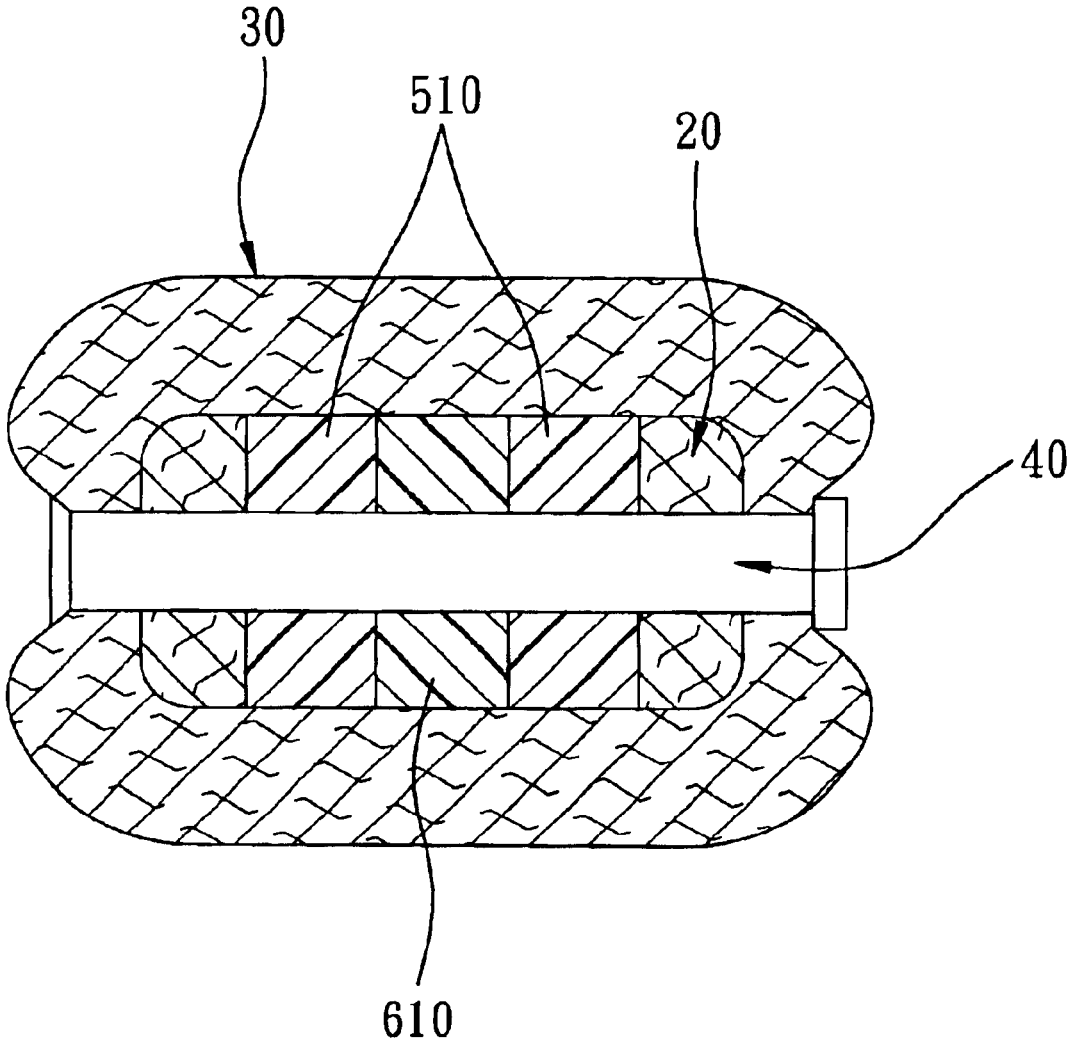
FIG. 4 is a sectional view of the first preferred embodiment, taken along lines 4—4 in FIG. 3.

The covering band 30 is retained on the first and second fastener bodies 50, 60 and is preferably made of the same material as the shoelace 200. In this embodiment, the covering band 30 is riveted on the pivot axle 40 so as to conceal the connection between the pull unit 20 and the pivot axle 40, as best shown in FIG. 4.

Figure 3:
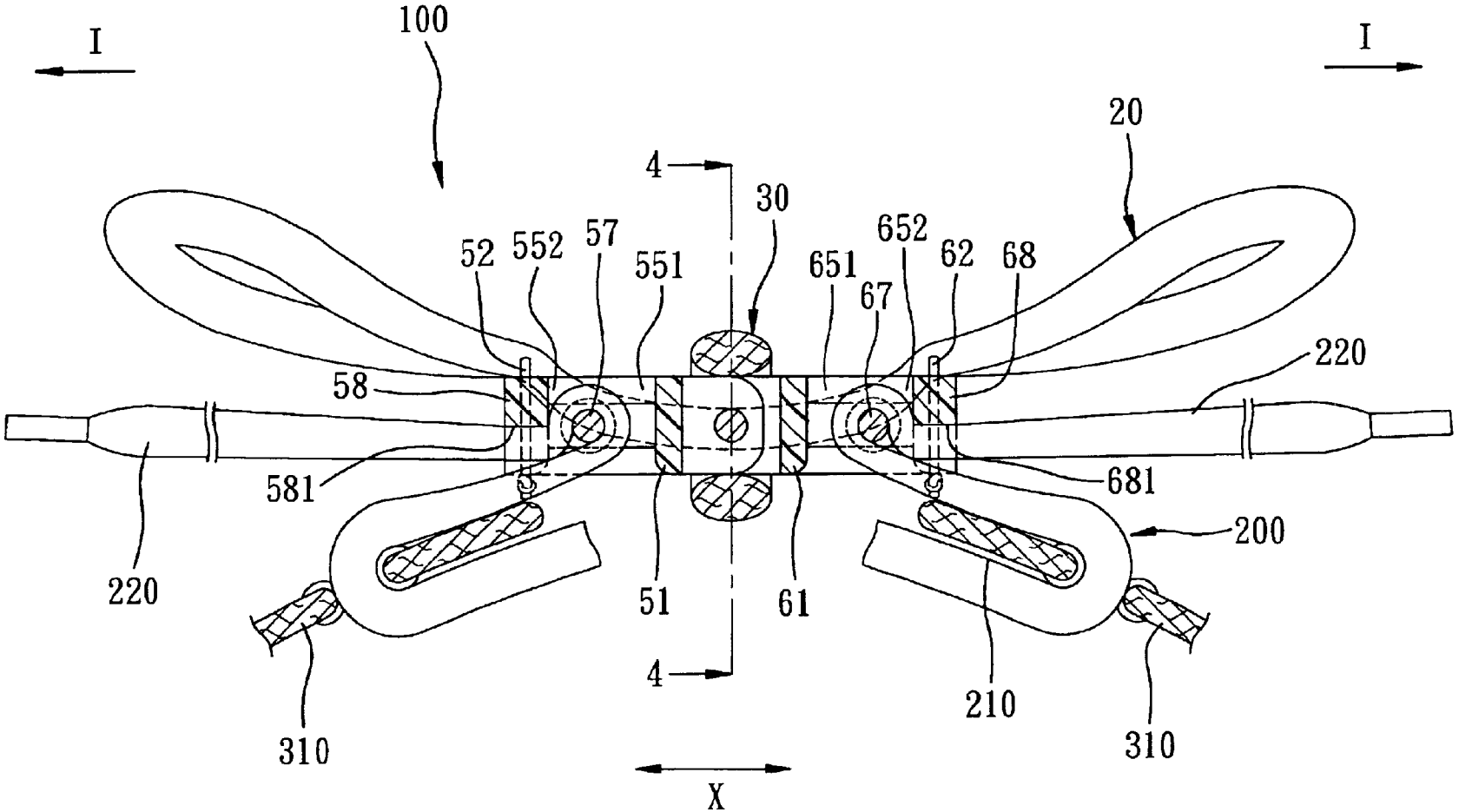
FIG. 3 is a schematic assembled sectional view of the first preferred embodiment to illustrate a tightening operation of a shoe that incorporates the first preferred embodiment.

As shown in FIGS. 3 and 5, in use, each of the distal lace segments 220 is extended through the lace entry side 551, 651 of the through hole 55, 65 in a respective one of the first and second fastener bodies 50, 60, over the clamping pin 57, 67 of the respective one of the first and second fastener bodies 50, 60, into the lace exit side 552, 652 of the through hole 55, 65 in the respective one of the first and second fastener bodies 50, 60, and out of the lace notch 581, 681 in the respective one of the first and second fastener bodies 50, 60. At this time, the pull unit 20, the covering band 30 and the distal lace segments 220 cooperate to form a double-bow configuration. After a foot (not shown) is slipped into the shoe body 300, the distal lace segments 220 can be pulled apart from each other as indicated by the arrows (I) in FIG. 3 to tighten the shoe body 300. When the shoe body 300 is tightened, the eyelet tabs 310 are forced apart by the foot in the shoe body 300, thereby applying tension on the shoelace 200. At this time, the clamping pins 57, 67 are forced by the respective distal lace segment 220 to move toward the outer frame portions 58, 68 of the first and second fastener bodies 50, 60 such that the distal lace segments 220 are clamped in the first direction (X) between the clamping pins 57, 67 and the outer frame portions 58, 68 of the first and second fastener bodies 50, 60 and along directions parallel to the hole axes (Z) between the eyelet tabs 310 of the shoe body 300 and upper edges (see FIG. 3) of the lace notches 581, 681 in the first and second fastener bodies 50, 60, thereby maintaining the tightened state of the shoe body 300.

Figure 6:
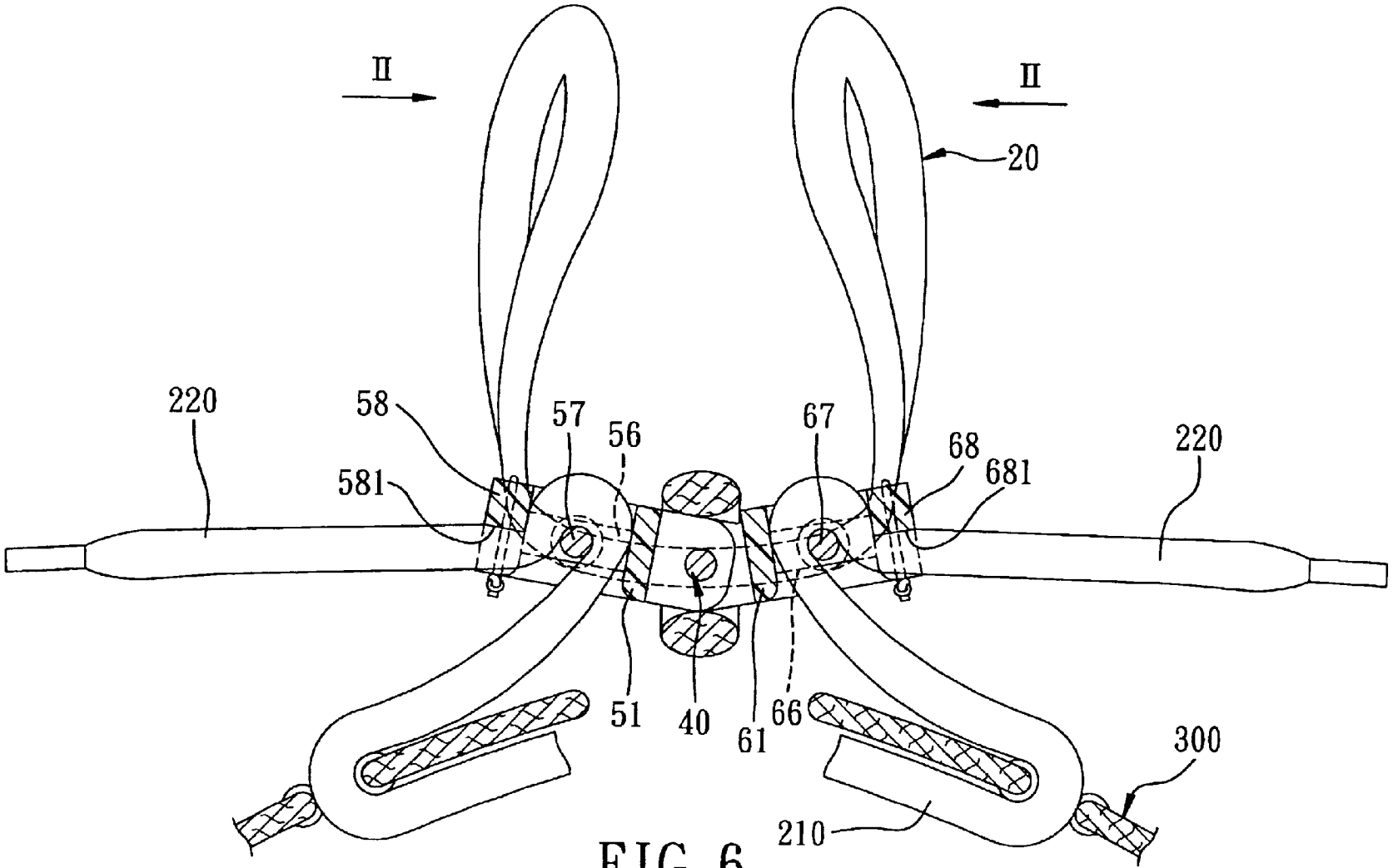
FIG. 6 is a view similar to FIG. 3, illustrating a loosening operation of the shoe.

As shown in FIG. 6, to loosen the shoe body 300, a manual pulling force is applied on the first and second fastener bodies 50, 60 through the pull unit 20. This results in relative pivoting movement between the first and second fastener bodies 50, 60 and in movement of the clamping pins 57, 67 toward the inner frame portions 51, 61 of the first and second fastener bodies 50, 60, thereby releasing the distal-lace segments 220 from being clamped by the clamping pins 57, 67 against the first and second fastener bodies 50, 60 so as to permit sliding movement of the distal lace segments 220 as indicated by the arrows (II) in FIG. 6 for loosening the shoe body 300 accordingly.

Figure 7:
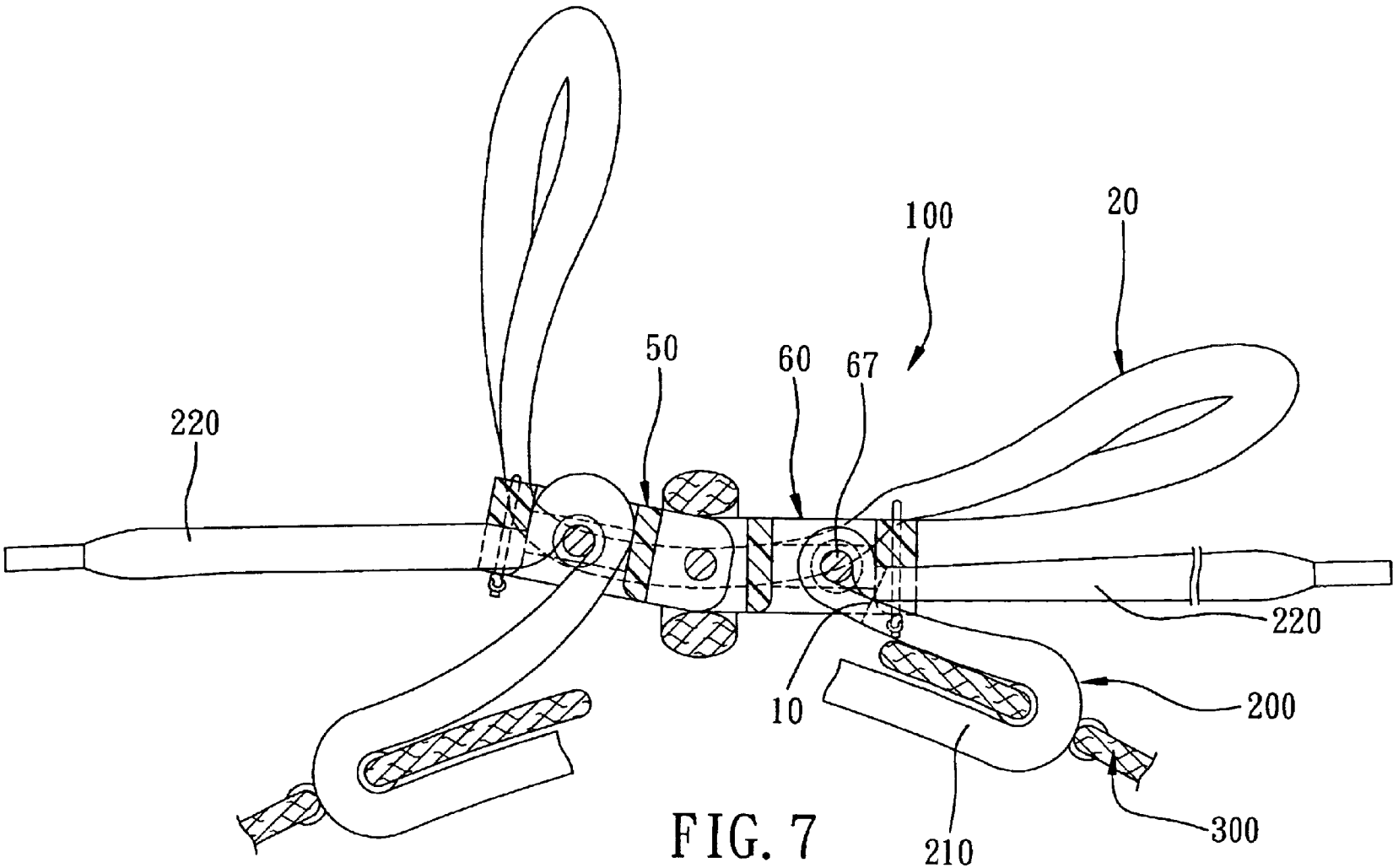
FIG. 7 is a schematic assembled sectional view of the second preferred embodiment of a shoelace fastener according to the present invention.

FIG. 7 illustrates the second preferred embodiment of a shoelace fastener 100 according to this invention, which is a modification of the previous embodiment. Unlike the first preferred embodiment, the shoelace fastener 100 of this embodiment further includes a fixing unit 10 in the form of a stitch seam that is provided on one of the distal lace segments 220 for fixing the latter on the respective clamping pin 67. Tightening of the shoe body 300 is accomplished by pulling at the other of the distal lace segments 220. Moreover, when an upward pulling force is exerted on the pull unit 20, only the other of the distal lace segments 220 will be permitted to slide for loosening the shoe body 300.

In sum, the shoelace fastener 100 of the present invention is easy to operate in view of the presence of the pull unit 20. Moreover, since there is no need to hold the fastener bodies 50, 60 when it is desired to loosen a shoe, the sizes of the fastener bodies 50, 60 can be designed to be smaller as compared to the prior art so as not to result in an adverse affect on the appearance of the shoe.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A shoelace fastener for a shoe, the shoe including a shoe body with a pair of eyelet tabs, and a shoelace strung on the eyelet tabs and having a pair of distal lace segments, said shoelace fastener comprising:

first and second fastener bodies disposed side by side in a first direction, each of said first and second fastener bodies being formed with a through hole that has a hole axis transverse to the first direction, each of said first and second fastener bodies further having inner and outer frame portions respectively proximate to and distal from the other of said first and second fastener bodies;

a pivot axle extending in a second direction transverse to the first direction and the hole axes, and pivotally interconnecting said inner frame portions of said first and second fastener bodies;

a pair of clamping pins, each of which is movably retained on a respective one of said first and second fastener bodies, extends in the second direction, is movable along the first direction between said inner and outer frame portions of the respective one of said first and second fastener bodies, and partitions said through hole in the respective one of said first and second fastener bodies into a lace entry side proximate to said inner frame portion, and a lace exit side proximate to said outer frame portion; and a pull unit secured on and disposed externally of said first and second fastener bodies;

whereby each of the distal lace segments is extendable through said lace entry side of said through hole in a respective one of said first and second fastener bodies, over said clamping pin of the respective one of said first and second fastener bodies, and into said lace exit side of said through hole in the respective one of said first and second fastener bodies;

whereby tension applied by the eyelet tabs upon the shoelace forces said clamping pins to clamp the distal lace segments respectively against said outer frame portions of said first and second fastener bodies for maintaining a tightened state of the shoe; and whereby a manual pulling force applied on said first and second fastener bodies through said pull unit results in relative pivoting movement between said first and second fastener bodies and in movement of at least one of said clamping pins toward said inner frame portion of the respective one of said first and second fastener bodies to permit sliding movement of at least one of the distal lace segments for loosening the shoe accordingly.

2. The shoelace fastener as claimed in claim 1, wherein each of said inner and outer frame portions extends in the second direction, said inner frame portion of each of said first and second fastener bodies being formed with a pivot lug unit, said pivot axle extending through said pivot lug units of said inner frame portions of said first and second fastener bodies.

3. The shoelace fastener as claimed in claim 1, wherein each of said first and second fastener bodies has top and bottom sides, said through holes being formed through said top and bottom sides of said first and second fastener bodies, each of said first and second fastener bodies further having a pair of side frame portions that extend in the first direction and that interconnect said inner and outer frame portions, each of said side frame portions being formed with a respective slot that extends in the first direction, each of said clamping pins having opposite ends slidably retained in said slots in said side frame portions of the respective one of said first and second fastener bodies.

4. The shoelace fastener as claimed in claim 3, wherein said outer frame portion of each of said first and second fastener bodies is formed with a lace notch that extends from said bottom side.

5. The shoelace fastener as claimed in claim 1, wherein said pull unit is an endless loop.

6. The shoelace fastener as claimed in claim 5, wherein said pull unit has parallel loop segments secured to opposite ends of said pivot axle, respectively.

7. The shoelace fastener as claimed in claim 6, further comprising a covering band retained on said first and second fastener bodies for concealing connection between said pull unit and said pivot axle.

8. The shoelace fastener as claimed in claim 5, wherein said pull unit is made of the same material as the shoelace.

9. The shoelace fastener as claimed in claim 1, wherein said pull unit is connected to said outer frame portions of said first and second fastener bodies.

10. The shoelace fastener as claimed in claim 9, wherein said outer frame portion of each of said first and second fastener bodies is formed with a string hole parallel to the hole axis, said shoelace fastener further comprising a pair of strings, each of which has a connecting end connected to said pull unit, extends through said string hole in said outer frame portion of a respective one of said first and second fastener bodies, and further has an anchoring end formed with a knot that abuts against the respective one of said first and second fastener bodies.

11. The shoelace fastener as claimed in claim 1, further comprising a fixing unit adapted for fixing one of the distal lace segments on the respective one of said clamping pins.

* * * * *